US007856712B2

(12) United States Patent
Busies et al.

(10) Patent No.: US 7,856,712 B2
(45) Date of Patent: Dec. 28, 2010

(54) METHOD OF MANUFACTURING A FEMALE TERMINAL

(75) Inventors: Rainer Busies, Wuppertal (DE); Dirk Placzko, Wuppertal (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/407,217

(22) Filed: Mar. 19, 2009

(65) Prior Publication Data

US 2009/0253315 A1 Oct. 8, 2009

(30) Foreign Application Priority Data

Apr. 3, 2008 (DE) ..... 10 2008 017 043

(51) Int. Cl.
*H01R 43/04* (2006.01)

(52) U.S. Cl. ..... 29/882; 29/874; 29/884; 29/885

(58) Field of Classification Search ..... 29/874, 29/882, 884, 885; 439/885
See application file for complete search history.

(56) References Cited

U.S. PATENT DOCUMENTS

| | | | | |
|---|---|---|---|---|
| 3,037,183 | A * | 5/1962 | Hopkins | 439/845 |
| 3,967,148 | A * | 6/1976 | Walsh | 310/239 |
| 5,187,862 | A * | 2/1993 | Ohsumi | 29/764 |
| 5,235,743 | A * | 8/1993 | Endo et al. | 29/885 |
| 5,350,321 | A | 9/1994 | Takenouchi | |
| 5,443,592 | A | 8/1995 | Ittah et al. | |
| 5,593,328 | A | 1/1997 | Okada et al. | |
| 5,601,458 | A | 2/1997 | Ohsumi et al. | |
| 5,611,715 | A | 3/1997 | Samejima | |
| 5,707,259 | A * | 1/1998 | Ishizuka et al. | 439/852 |
| 6,062,918 | A | 5/2000 | Myer et al. | |
| 6,264,509 | B1 | 7/2001 | Kwang et al. | |
| 6,447,345 | B2 | 9/2002 | Sato et al. | |
| 6,527,601 | B2 | 3/2003 | Chen | |
| 6,679,738 | B2 | 1/2004 | Nimura | |
| 6,761,597 | B2 | 7/2004 | Shimizu | |
| 6,971,927 | B2 | 12/2005 | Anbo et al. | |
| 7,048,551 | B2 | 5/2006 | Takayama | |
| 7,094,115 | B2 | 8/2006 | Noro et al. | |
| 7,115,004 | B2 | 10/2006 | Takayama | |
| 7,147,522 | B2 | 12/2006 | Kobayashi et al. | |
| 7,156,704 | B2 | 1/2007 | Shimizu | |

(Continued)

FOREIGN PATENT DOCUMENTS

DE 19704311 A1 8/1998

(Continued)

*Primary Examiner*—C. J Arbes
(74) *Attorney, Agent, or Firm*—Brooks Kushman P.C.

(57) ABSTRACT

A method for manufacturing a female electrical terminal includes, according to one embodiment, blanking of strip of conductive material and forming a wire connecting portion to receive an electrical wire. The blank may include a contact arm extending into an area adjacent the wire connecting portion. The contact arm extends into this area from a terminal connecting portion at a predetermined angle. The contact arm may be straightened and folded prior to bending the terminal connecting portion into a tubular member for receiving the tab of a male terminal. The step of straightening the contact arm can be performed using a special coining process that applies pressure to the conductive material around the shoulder causing the conductive material to flow within a confined area allowing the contact arm to be straightened.

9 Claims, 2 Drawing Sheets

U.S. PATENT DOCUMENTS

| | | | |
|---|---|---|---|
| 2005/0191912 | A1 | 9/2005 | Maeda |
| 2006/0172618 | A1 | 8/2006 | Yamashita et al. |

FOREIGN PATENT DOCUMENTS

| | | | |
|---|---|---|---|
| DE | 102004053788 | A1 | 6/2005 |
| EP | 1137108 | A1 | 9/2001 |
| EP | 1146597 | A2 | 10/2001 |
| EP | 1507316 | A1 | 2/2005 |
| WO | 2003/003524 | A2 | 1/2003 |

* cited by examiner

METHOD OF MANUFACTURING A FEMALE TERMINAL

CROSS-REFERENCE TO RELATED APPLICATIONS

This application claims foreign priority benefits under 35 U.S.C. §119(a)-(d) to DE 10 2008 017 043.7, filed Apr. 3, 2008, which is hereby incorporated by reference in its entirety.

TECHNICAL FIELD

The following relates to an electrical terminal and manufacturing method for electrical connections in vehicular and other environments.

A detailed description and accompanying drawings are set forth below.

DETAILED DESCRIPTION

With reference to FIGS. 1-4, a more detailed description of embodiments of the terminal and manufacturing method and various components thereof will now be provided. An electrical terminal is a conductive device for joining electrical circuits together. It is well know that the connection may be temporary, may require a tool for assembly, or may be a permanent electrical joint between two wires or devices.

Crimp-on terminals are electrical terminals that are, for example, attached to wires to be easily connected to screw terminals or fast-on/quick-disconnect terminals. Thus, crimp-on terminals may connect two wires together either permanently or with disconnect capability. Typically, crimp-on terminals are attached by inserting the stripped end of a stranded wire into the wire connecting portion of the terminal. This wire connection portion is then compressed tightly around the wire or "crimped" by squeezing the wire connecting portion with a special crimping device.

It is well known in the automotive industry that cars are equipped with numerous electrical components, most of which require a bundle of wires to operate. Thus, in today's vehicles, electrical connectors are especially critical. Without them, it would be nearly impossible to build or service a car. For example, whenever a bundle of wires passes through or attaches to a component of a car that might have to be removed, there must be a connector there to allow for that removal. Moreover, connectors may be required to connect one group of wires to another group of corresponding wires to complete circuits throughout the vehicle. A single connector can house any number of electrical wires and electrical wire terminals simplifying the connection and disconnection of bundles of wires in automotive an other environments.

Electrical terminals come in various shapes, sizes and configurations. Female terminals typically have male counterparts for making reliable electrical connections. The tab of a male terminal may be securely inserted into a female terminal for joining together an electrical circuit. Female terminals may be designed for insertion into specific connectors. Additionally, female terminals may be designed to receive particular male terminals or vice versa. In order to facilitate a reliable and constant terminal engagement, the female terminal design may include a spring arm or some other contact surface within a terminal interior to apply pressure to the tab of a male terminal to hold the male terminal in place and maintain electrical contact.

Figure 1:
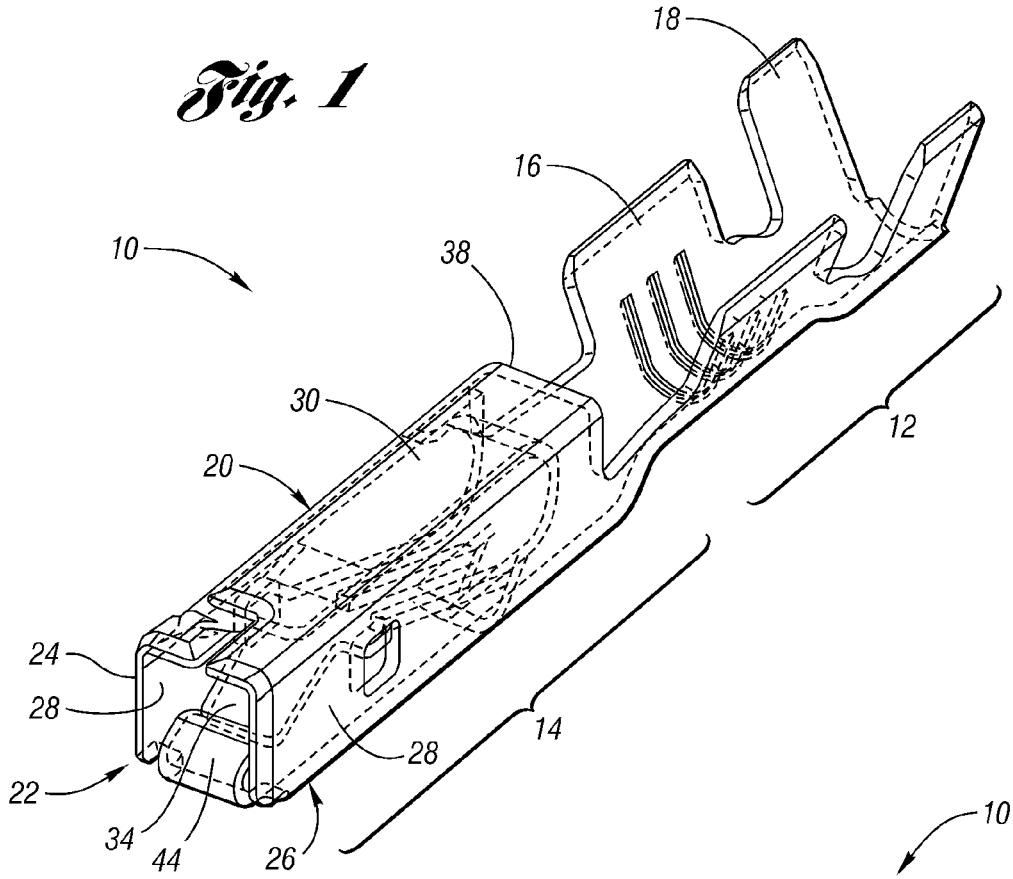
FIG. 1 is a simplified, exemplary environmental diagram depicting one embodiment of the terminal described herein.

Referring now to the drawings, FIG. 1 is a simplified, exemplary environmental diagram depicting one embodiment of an electrical terminal 10. Electrical terminal 10 is a female terminal comprising wire connecting portion 12 at one end and terminal connecting portion 14 at the other end. Wire connecting portion 12 may include, for example, bare wire crimping section 16 and insulation crimping section 18. As shown in FIG. 1, bare wire crimping section 16 and insulation crimping section 18 can be formed into a generally V-shaped claw 19 for receiving the end of an electrical wire (not shown). Using an appropriate crimping tool or machine, bare wire crimping section 16 can be wrapped around the stripped end of an electrical wire in which a core conductor is exposed. Meanwhile, insulation crimping section 18 can be wrapped around a sheath of insulation immediately adjacent the stripped end exposing the core conductor. A crimping device compresses the two crimping sections 16,18 securing electrical terminal 10 to the electrical wire and ensuring strong electrical contact between terminal 10 and the core conductor of the electrical wire.

Terminal connection portion 14 of electrical terminal 10 can be a substantially rectangular tubular member 20 having terminal insertion opening 22 formed by a front edge 24 of terminal connecting portion 14. Terminal insertion opening 22 may be configured to receive a tab a male terminal (not shown). As shown in FIGS. 1 and 2, terminal connecting portion 14 can include bottom portion 26, two opposing side walls 28 that stand up from opposite lateral edges of bottom portion 26, and upper portion 30 bridging the top extending ends of opposing side walls 28 to oppose bottom portion 26. The terms top and bottom are used herein as a convenient frame of reference, but are not intended to imply required gravitation orientation. Accordingly, terminal connecting portion 14 can be a generally box-shaped member having a substantially rectangular tubular interior.

A polarization tab 32 may project outward from bottom portion 26. Polarization tab 32 can help secure electrical terminal 10 into an electrical connector housing (not shown) with the proper orientation.

Figure 2A:
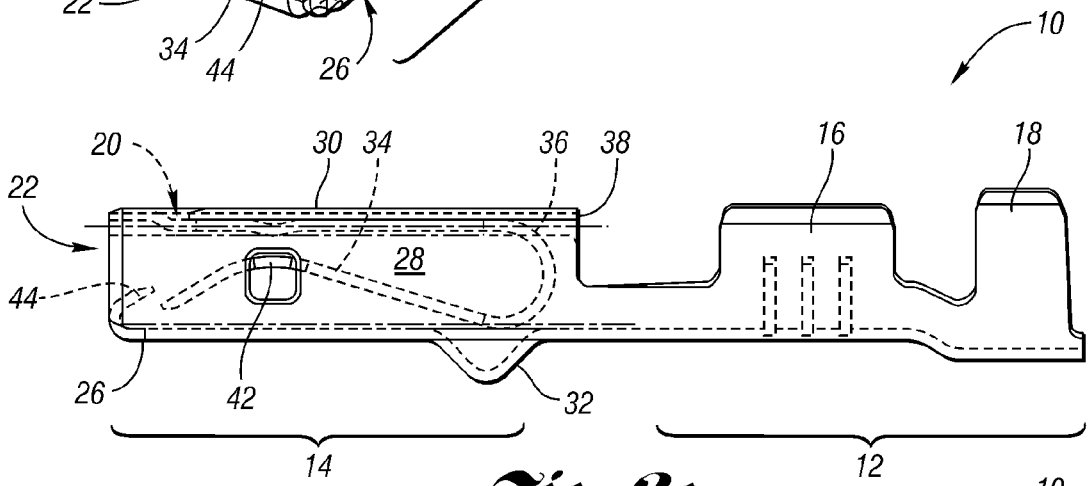
FIG. 2*a* is a simplified, exemplary profile diagram depicting one embodiment of the terminal described herein.
Figure 2B:
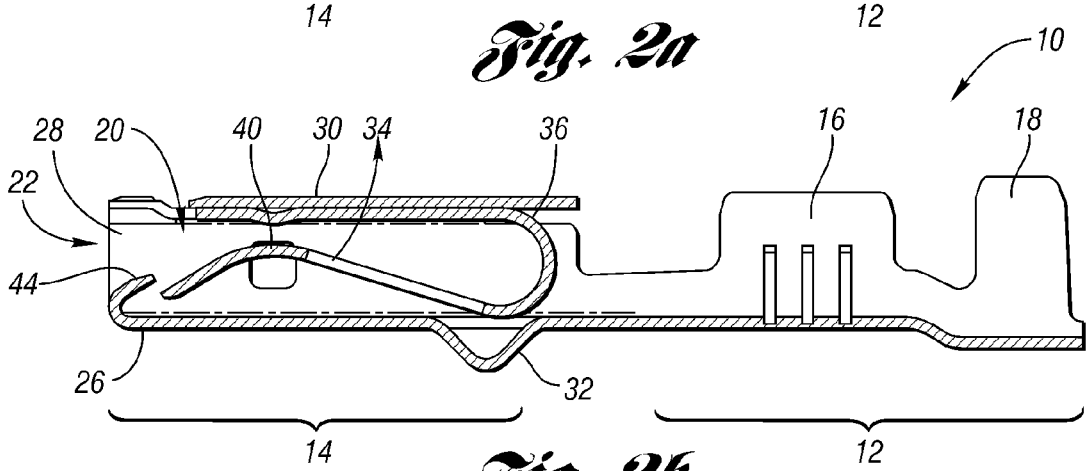
FIG. 2*b* is a simplified, exemplary cross-sectional diagram depicting one embodiment of the terminal described herein.

As best shown in FIGS. 2*a* and 2*b*, terminal connecting portion 14 includes contact arm 34. Contact arm 34 may cantilever forward from shoulder 36 at a back edge 38 of upper portion 30 of terminal connecting portion 14 into tubular member 20. Contact arm 34 can extend from back edge 38 of upper portion 30 into the interior of terminal connecting portion 14 towards terminal insertion opening 22. Contact arm 34 may be folded and shaped within the interior of terminal connecting portion 14 to form a resilient spring.

Contact arm 34 may include contact face 40 defining the location where a spring force is applied by contact arm 34. Contact face 40 can be located proximate upper portion 30 defining a slot for the tab of a male terminal to be inserted. Spring force from contact face 40 can press the male terminal against upper portion 30 to retain the male terminal within the interior of terminal connecting portion 14. Contact arm 34 may apply sufficient force to the male terminal to prevent the male terminal from disengaging from electrical terminal 10 unintentionally while simultaneously maintaining constant electrical contact between electrical terminal 10 and the male terminal. It should be noted that the spring force established by contact arm 34 may be varied by varying the shape of contact arm 34. For example, the width of contact arm 34 may be increased or decreased, or contact arm 34 may be tapered from shoulder 36 to contact face 40. Alternatively, a slot 41 (best shown in FIG. 3) may be punched into contact arm 34. To this end, the stamping tool which stamps a blank terminal 10 may include exchangeable dies to allow for adjustment of the spring characteristic.

Contact face 40 of contact arm 34 may be located proximate terminal insertion opening 22 such that it is capable of receiving male terminals relatively short in length. Of course, positioning contact face 40 near terminal insertion opening in this manner may not preclude electrical terminal 10 from receiving male terminals of a longer length.

Contact arm 34 may also include laterally extending spring overstress regions 42 on opposite sides of contact face 40. Spring overstress regions 42 may resemble a pair of opposing tabs extending outward away from contact arm 34 in a generally transverse direction. Spring overstress regions 42 may provide sufficient protection to avoid plastic deformation of contact arm 34.

As shown in FIGS. 1 and 2, contact arm 34 may be fully enclosed within tubular member 20 defined by terminal connecting portion 14. Enclosing contact arm 34 in such a way can protect contact arm 34 against damage. Moreover, terminal connecting portion 14 may include probing surface 44 which doubles as spring protection against misaligned male terminal tabs during tab insertion. Probing surface 44 may be located at terminal insertion opening 22 and defined by a section of bottom portion 26 folded inward toward the interior of tubular member 20 of terminal connecting portion 14. Probing surface 44 can deflect misaligned tabs from male terminals toward the upper portion 30 encouraging receipt of the male tab into the slot formed between upper portion 30 and contact face 40 of contact arm 34. Further, probing surface 44 can provide a convenient contact area for electrical probing.

Figure 3:
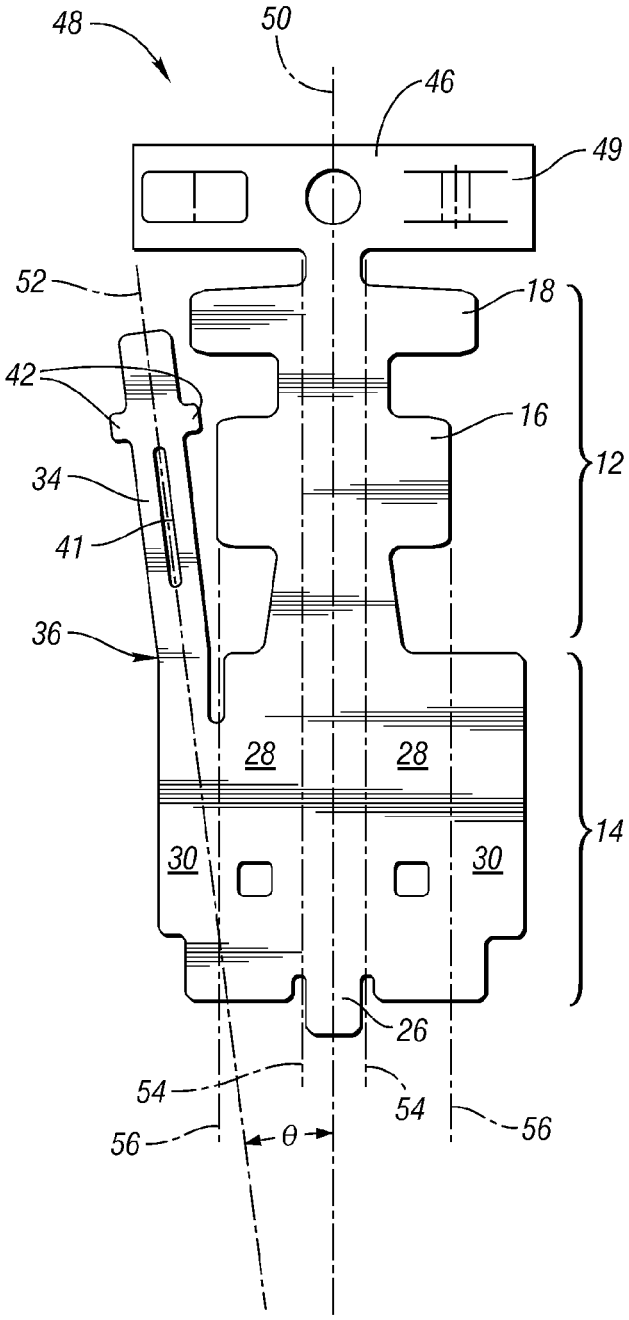
FIG. 3 is a simplified, exemplary top view depicting one embodiment of the terminal blank described herein.

Referring now to FIG. 3, wherein like elements are represented by like reference numerals, electrical terminal 10 may be initially formed by stamping or blanking electrically conductive material 46 into the shape as shown in FIG. 3, in accordance with an embodiment of the present invention. Thus, FIG. 3 depicts a pre-formed terminal cutout 48 that can then be shaped through various manufacturing processes into the electrical terminal 10 as shown in FIGS. 1 and 2. Pre-formed terminal cutout 48 includes carrier strip 49 connecting a series of electrical terminals together during the manufacturing process. Carrier strip 49 can also provide an index for locating each terminal 10 as it is manufactured. Eventually carrier strip 49 is cut from electrical terminal 10 and becomes scrap material.

Pre-formed terminal cutout 48 may include wire connecting portion 12 and terminal connecting portion 14. As described with reference to FIGS. 1 and 2, wire connecting portion 12 includes bare wire crimping sections 16 and insulation crimping sections 18. Contact arm 34 can extend rearward from terminal connecting portion 14 in the general direction of wire connecting portion 12. Shoulder 36 defines the joint between contact arm 34 and upper portion 30 of terminal connecting portion 14 from which contact arm 34 extends. Contact arm 34 can be angled outward slightly away from wire connecting portion 12 of pre-formed terminal cutout 48 so as to separate contact arm 34 from wire connection portion 12, and provide room for the corresponding portions to be blanked from a strip of conductive material 46. By locating contact arm 34 of pre-formed terminal cutout 48 in the general area surrounding wire connecting portion 12, significant cost and material savings can be achieved. Specifically, contact arm 34 may be stamped out of the would be scrap material surrounding wire connecting portion 12. By creating contact arm 34 out of this otherwise scrap material, as much as 30% or more of material savings may be realized.

Again, the shape of contact arm 34 may be varied. The width can be increased or decreased, contact arm 34 may be tapered, or slot 41 may be punched into contact arm 34. Varying the shape of contact arm 34 varies the spring characteristic in accordance with design standards and requirements. To this end, the stamping tool which stamps conductive material 46 into pre-formed terminal cutout 48 may include exchangeable dies to allow for adjustment of this spring characteristic.

Pre-formed terminal cutout 48 of electrical terminal 10 may have a primary longitudinal axis as shown by line 50 in FIG. 3. Meanwhile, contact arm 34 of pre-formed terminal cutout 48 can include a secondary longitudinal axis as defined by line 52 in FIG. 3. As previously described, contact arm 34 of pre-formed terminal cutout 48 may be angled slightly away from wire connecting portion 12 to make room for bare wire crimping sections 16 and insulation crimping sections 18. As shown, an angle θ may exist between axis 50 and axis 52. Angle θ between axis 50 and axis 52 may be in the range of 5°-10°. In an embodiment of the present application, angle θ may be approximately 7°. It should be noted, however, that lesser or greater angles are contemplated herein without departing from the scope of the present application.

Pre-formed terminal cutout 48 may be formed into electrical terminal 10 as shown in FIG. 1 through various manufacturing operations, including bending, folding, forming, straightening, or the like. To this end, pre-formed terminal cutout 48 may be bent or folded approximately along chain lines 54, 56 as shown in FIG. 3. Chain lines 54,56 delineate bottom portion 26 from opposing side walls 28, and opposing side walls 28 from upper portion 30 of terminal connecting portion 14.

Figure 4:
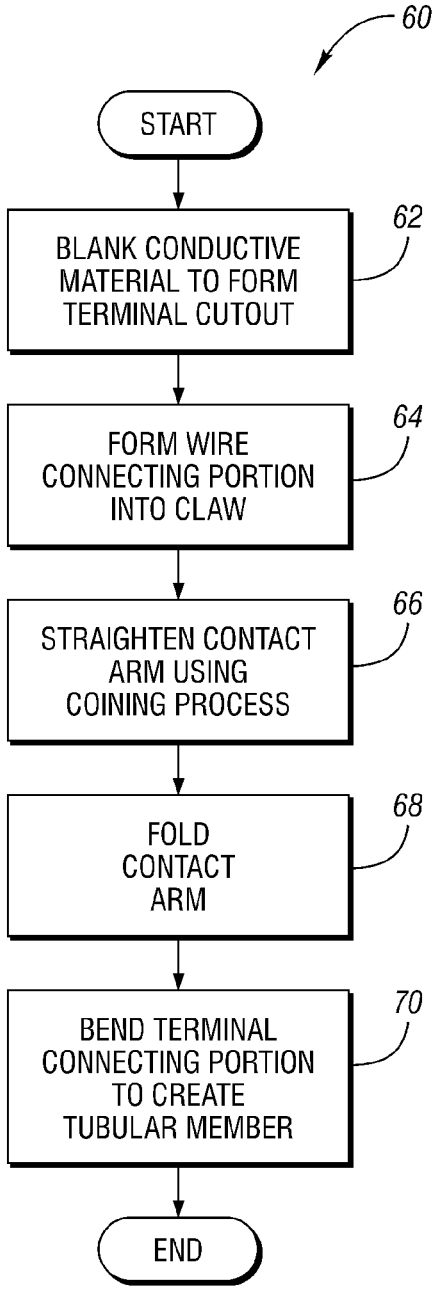
FIG. 4 is a simplified, exemplary flow chart depicting one embodiment of the method described herein.

Referring now to FIG. 4, a simplified, exemplary flowchart 60 depicting one embodiment of a method for forming electrical terminal 10 from a strip of conductive material 46 is shown. As seen therein, a strip of conductive material 46 may be stamped or blanked to create pre-formed terminal cutout 48, as illustrated in FIG. 3, at step 62. Once pre-formed terminal cutout 48 is generated during blanking step 62, wire connecting portion 12 can be formed at step 64. The forming step 64 may include bending each bare wire crimping section 16 and each insulation crimping section 18 generally upward approximately along the depicted chain line 54 to form generally V-shaped claw 19, best shown in FIG. 1. By forming wire connecting portion 12 into claw 19, a vacancy is created where bare wire crimping section 16 and insulation crimping section 18 previously occupied. Thus, the claw forming step 64 can provide the necessary space which can be utilized when straightening contact arm 34.

To this end, at step 66, contact arm 34 may then be straightened at shoulder 36 such that the longitudinal axis 52 of contact arm 34 can become generally parallel to the longitudinal axis 50 of electrical terminal 10. In order to properly straighten contact arm 34 so that it can be in alignment with upper portion 30 of terminal connecting portion 14, a special coining process may be used. During the coining process, conductive material 46 is squeezed at or near a confined area around shoulder 36 causing conductive material 46 to flow in such a way that allows contact arm 34 to be straightened without bending pre-formed terminal cutout 48.

After the straightening step 66, contact arm 34 may be folded at shoulder 36 down longitudinal axis 50 (or along a line orthogonal to longitudinal axis 50), at step 68. By folding contact arm 34 at shoulder 36, only a single fold may be required to redirect contact arm 34 towards front edge 24 of terminal connecting portion 14. During this folding step 68, contact arm 34 can be folded down axis 50 toward front edge 24 of terminal connecting portion 14. By folding contact arm 34 at shoulder 36, only a single fold may be required to redirect contact arm 34 towards front edge 24 of terminal connecting portion 14. The net result may be additional material savings.

Next, at step 70, terminal connecting portion 74 may be bent along corresponding chain lines 54,56 to form box-shaped tubular member 20 defined by bottom portion 26, opposing side walls 28, and upper portion 30 opposing bottom portion 26. In that regard, contact arm 34 may be folded to cantilever from upper portion 30 into tubular member 20 toward terminal insertion opening 22, thereby forming a resilient spring. The spring force of contact arm 34 can provide pressure at contact face 40 against a male terminal upon insertion into terminal insertion opening 22 to retain the male terminal in constant electrical contact with electrical terminal 10.

It should be noted that the method of FIG. 4 as described herein is exemplary only, and that the functions or steps of the method could be undertaken other than in the order described and/or simultaneously as may be desired, permitted and/or possible. For example, prior to forming wire connecting portion 12, contact arm 34 may folded into its shape and position as previously described. The step of straightening contact arm 34 may be implemented during this step.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for manufacturing a female terminal for receiving a male terminal, the method comprising:

blanking a strip of conductive material to provide a preformed terminal cutout having a wire connecting portion at one end, a terminal connecting portion at another end, and a contact arm extending from the terminal connecting portion, at a shoulder, toward the wire connecting portion at an angle permitting the contact arm to reside adjacent the wire connecting portion;

forming the wire connecting portion upwards to form a claw for receiving a core conductor and a sheath of an electrical wire;

straightening the contact arm at the shoulder so that the contact arm's longitudinal axis is generally parallel to the female terminal's longitudinal axis, wherein the claw forming step provides a vacancy for the contact arm to reside after the straightening step;

folding the contact arm at the shoulder along the longitudinal axis of the contact arm toward a front edge of the terminal connecting portion;

bending the terminal connecting portion into a tubular member having opposing side walls and an upper portion opposing a bottom portion defining a terminal insertion opening, the contact arm being folded to cantilever from the upper portion into the tubular member toward the terminal insertion opening forming a resilient spring that contacts the male terminal upon insertion.

2. The method of claim 1, wherein the straightening step comprises coining the contact arm at the shoulder such that the conductive material flows within a confined area straightening the contact arm.

3. The method of claim 1, wherein the contact arm is angled approximately 5 to 10 degrees from the female terminal's longitudinal axis.

4. The method of claim 3, wherein the contact arm is angled approximately 7 degrees from the female terminal's longitudinal axis.

5. The method of claim 1, wherein the spring force of the contact arm is adjusted by varying the width of the contact arm.

6. A method for manufacturing a female terminal for receiving a male terminal, the method comprising:

blanking a strip of conductive material to provide a preformed terminal cutout having a wire connecting portion at one end, a terminal connecting portion at another end, and a contact arm angularly extending from the terminal connecting portion, at a shoulder, toward an area adjacent the wire connecting portion;

forming the wire connecting portion upwards to form a claw for receiving a core conductor and a sheath of an electrical wire;

coining the contact arm at the shoulder so that the contact arm's longitudinal axis is generally parallel to the female terminal's longitudinal axis, wherein forming the wire connecting portion into the claw makes room for the contact arm to be straightened;

folding the contact arm at the shoulder along the longitudinal axis of the contact arm toward a terminal insertion opening of the terminal connecting portion;

bending the terminal connecting portion into a box-shaped member having opposing side walls and an upper portion opposing a bottom portion defining the terminal insertion portion, the contact arm being folded to cantilever from the upper portion into the box-shaped member toward the terminal insertion opening forming a resilient spring that contacts the male terminal upon insertion.

7. The method of claim 6, wherein the contact arm is angled approximately 5 to 10 degrees from the female terminal's longitudinal axis.

8. The method of claim 7, wherein the contact arm is angled approximately 7 degrees from the female terminal's longitudinal axis.

9. The method of claim 6, wherein the spring force of the contact arm is adjusted by varying the width of the contact arm.

* * * * *